United States Patent [19]

Hopfer

[11] 4,438,415

[45] Mar. 20, 1984

[54] DIGITAL PROGRAMMABLE ATTENUATOR

[75] Inventor: Samuel Hopfer, Brooklyn, N.Y.

[73] Assignee: General Microwave Corporation, Farmingdale, N.Y.

[21] Appl. No.: 343,737

[22] Filed: Jan. 29, 1982

[51] Int. Cl.[3] ..... H01P 1/22

[52] U.S. Cl. ..... 333/81 A; 333/164; 333/246

[58] Field of Search ..... 333/81 A, 81 R, 164, 333/117, 109, 116

[56] References Cited

U.S. PATENT DOCUMENTS

| | | | |
|---|---|---|---|
| 3,346,823 | 10/1967 | Maurer et al. | 333/117 |
| 3,496,492 | 2/1970 | Kurzl et al. | 333/116 |
| 4,121,183 | 10/1978 | Murphy | 333/81 R |
| 4,138,637 | 2/1979 | Weinert | 333/81 R X |
| 4,288,763 | 9/1981 | Hopfer | 333/164 |

OTHER PUBLICATIONS

Rathai, W., Banerjee, S. K., "Precision Programmable Attenuator", *News from Rohde and Schwarz,* vol. 12, (1972), pp. 26–28.

*Primary Examiner*—Paul L. Gensler
*Assistant Examiner*—Benny Lee
*Attorney, Agent, or Firm*—Morton C. Jacobs

[57] ABSTRACT

A digitally programmable attenuator for high speed and a large dynamic range is constructed with a phase-controlled attenuator for small steps of attenuation and an attenuator of switched resistive pads for larger steps. The attenuators are connected in tandem and actuated combinatorially with the phase-controlled attenuator being switched into operation for the small steps, and the resistive pads being switched into operation for the large steps. A phase-controlled attenuator is constructed to permit adjustment of the attenuator characteristic, and a switched-pad attenuator is constructed to be phase shiftless.

20 Claims, 5 Drawing Figures

DIGITAL PROGRAMMABLE ATTENUATOR

BACKGROUND OF THE INVENTION

This invention relates to variable attenuators for microwave signals, and particularly to such attenuators or amplitude modulators that can be digitally programmed over a broad range of radio frequencies.

An attenuator that may be programmed for such use is a switched resistive-pad attenuator in which resistive pads of different values, or combinations of values, of attenuation are switched in and out of operation as desired. Such attenuators are suitable for switching large steps of attenuation at high speed. However, there are situations where the programmed steps of attenuation are very small (e.g., up to several db) and where accuracy requires coming within a small percentage of final value (e.g., 0.1 or 0.2 db). Then the attenuation of the pin diode itself is a significant part of the attenuation step, and the switching speed of the pin diode is also a significant factor of the overall switching speed. Such attenuators, in the latter situations, particularly in frequency ranges above 8 GHz, tend to be too slow in switching speed; in addition they have linearity and flatness problems, and they have high insertion loss.

Another form of attenuator is one employing variable reactors; an example is an attenuator (such as that of U.S. Pat. No. 3,346,823) based on the use of an analog phase shifter. Even where such a phase-controlled attenuator employs the phase shifter of U.S. Pat. No. 4,288,763, such a device tends to be limited in its attenuation range in a single attenuator (using two or three phase-shifter stages). For a large operating range of attenuation, cascaded identical phase-controlled attenuators would be required, but in such a multi-attenuator configuration, the deviations from flatness in each attenuator are cumulatively excessive. Moreover, such a configuration would have high insertion loss also.

SUMMARY OF THE INVENTION

Accordingly, it is among the objects of this invention to provide a new and improved programmable attenuator.

Another object is to provide a new and improved programmable attenuator that is operable at extremely high speeds.

Still another object is to provide a new and improved programmable attenuator that is operable to produce a large dynamic range of attenuation with high resolution.

Another object is to provide a new and improved programmable attenuator in which the insertion loss is kept to usable levels.

Another object of this invention is to provide a multistage programmable attenuator which operates monotonically.

Another object is to provide a new and improved switch pad attenuator.

Another object is to provide a new and improved phase-controlled programmable attenuator.

In accordance with an embodiment of this invention, a new and improved digitally programmable attenuator is constructed with a phase-controlled attenuator for small steps of attenuation and a switched resistive pad attenuator for large steps of attenuation. The attenuators are connected in tandem to combine said large and small steps and are actuated combinatorially to switch the phase-controlled attenuator into operation for the small steps, and the resistive pads into operation for the large steps.

In accordance with a feature of this invention, the switched resistive pad attenuator is constructed with two alternative paths that are isolated and of the same electrical length for the insertion loss and attenuation paths, so that it operates as a phase shiftless attenuator (in each of the plurality of stages).

In accordance with another feature of this invention, the phase controlled attenuator is constructed with balanced phase shifter paths with variable bias applied to one phase shifter and fixed reference biasing to the other that permits adjustment of the attenuation characteristic.

BRIEF DESCRIPTION OF THE DRAWING

The foregoing and other objects of this invention, the various features thereof, as well as the invention itself will be more fully understood from the following description, when read together with the accompanying drawing in which.

DETAILED DESCRIPTION OF THE INVENTION

Figure 1:
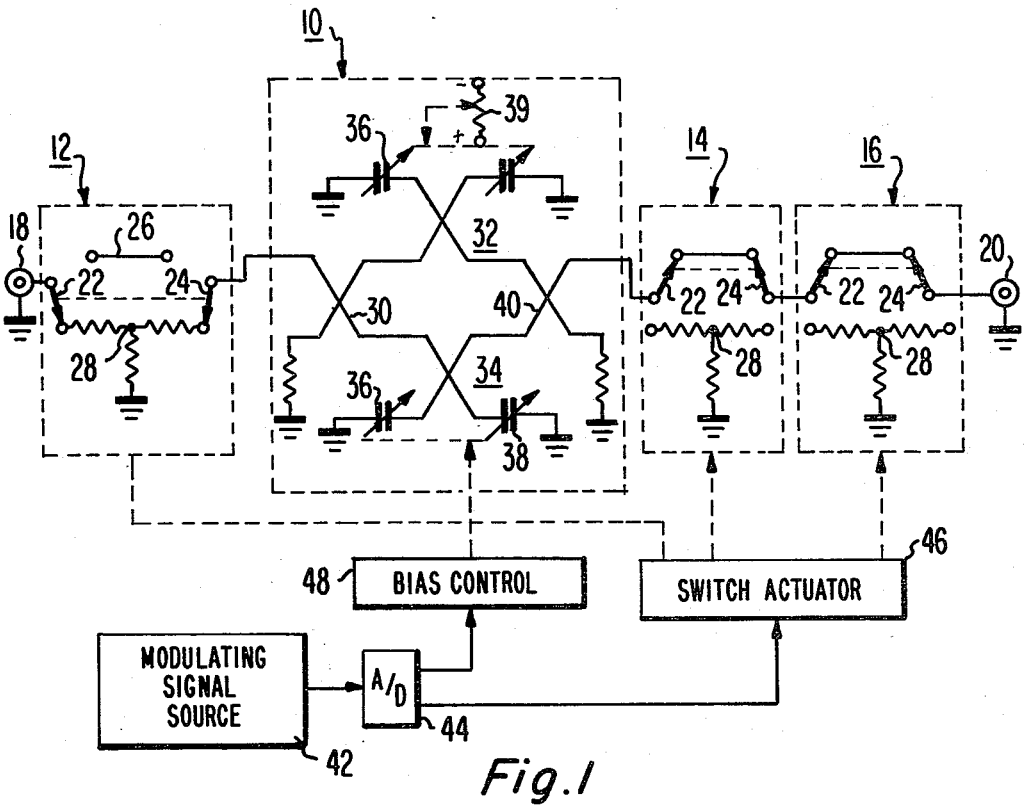
FIG. 1 is a schematic circuit diagram of a digitally programmable phase-controlled and switched resistive-pad attenuator embodying this invention.

The high speed digital attenuator of this invention is illustrated as a schematic circuit in FIG. 1. The attenuator consists of a stage 10 (or more than one stage) of an analog attenuator employing a phase shifter and a stage of a digital switch pad attenuator 12 and as many additional switch pad stages as desired. In the illustrated embodiment of FIG. 1, two additional stages 14 and 16 of a switch pad attenuator are employed. The first stage 12 is connected to an input terminal 18, and an output terminal 20 is connected to the last stage 16. The terminals 18 and 20 can be reversed in function and the circuit presented to a signal at either terminal is essentially the same in its material characteristics, so that it operates similarly in either direction to provide bilateral symmetry of input circuitry. In addition, positioning the phase shifter attenuator between switch pad attenuator stages tends to reduce insertion loss reflectances between those switch pad stages.

Each switch pad attenuator stage includes a pair of single-pole single-throw switches 22, 24 which are ganged to operate in one condition at contacts for a straight through path 26 and in an opposite condition at contacts between which is an attenuation path 28. Illustratively, the latter includes a resistive pad made up of resistive strips fabricated of thin evaporated films to form an attenuator of high precision and uniformity over a broad microwave bandwidth. Thus, for the switch position illustrated for stage 12, there is an attenuation corresponding to the fixed value of the resistive pad (which may be a T-pad or any other suitable configuration). In the opposite switch position, the attenuation path 28 is out of the circuit and the straight-through path 26 is in the circuit, so that there is no additionall attenuation beyond that of the insertion loss of the circuit itself. By way of example, the switch pad for stage 12 may be that of 8.8 db, that of stage 14 may be 17.6 db and that of stage 16 may be 35.2 db; two 17.6 db pads may be used for 35.2 db.

The phase shifter attenuator, in its preferred form of the invention, is constructed in a fashion similar to the phase shifter described in applicant's U.S. Pat. No. 4,288,763, which is here incorporated by reference. It consists of a phase splitter 30, the two outputs of which are supplied to phase shifter stages 32 and 34 arranged in a balanced arrangement in parallel channels so that they track each other. Each of the latter includes a passive device (such as a hybrid coupler or a circulator), two of whose ports are connected through varactors 36, 38 respectively to ground, a third port is connected as an input to one output of the power splitter 30, and the other is connected to an input port of combiner 40. The phase splitter 34 is similarly constructed. One terminal each of the splitter and combiner 30 and 40 is terminated through a resistor 39, and the other port serves as an input or output port to the adjacent switch pad attenuator 12 or 14. Thus, the analog phase shifter, in its preferred form, also has a bilateral symmetry, so that the entire circuit can function symmetrically in either direction. Generally, two or three phase shifter stages are in each channel.

The modulating signal is supplied from a suitable source 42 and may be in analog form, which is converted to digital form by an A/D converter 44. The digital signal is developed in terms of the db values of the respective stages of the circuit. Thus, in one construction of the invention, the most significant bits of the digital signal respectively represent the db values of 8.8, 17.6 and 35.2, and these values over the range of 8.8 to 61.6 db can be combinatorially switched by similarly switching the associated pads. The least significant bits are used for the attenuation values to be achieved by the phase-controlled attenuator. These vary from 0.55 through 8.2 db. They can be developed digitally in steps of 0.55 db in which 4 bits represent the values 0.55, 1.1, 2.2 and 4.4 respectively, and they can be combinatorially switched over the range of 0 to 8.2 db. The combined range in this example is from 0 to 69.8 db in steps of 0.55 db.

Digital bits corresponding to the switch pad values are supplied to a switch actuator 46 for supplying the signals that actuate the switches to the respective insertion-loss path 26 (i.e., the path in which there is no attenuation beyond that of the device's insertion loss) or to attenuation path 28 in each stage. The least significant bits are supplied to a bias control for the varactors 36 and 38 in the manner explained in the aforementioned U.S. Pat. No. 4,288,763.

In a preferred form of the invention, the varying bias signals are supplied to the varactors 36, 38 of the channel 34, and the bias supplied to varactors 36 and 38 of phase shifter 32 is a fixed value. Thereby, phase shifter 32 operates as a reference against which phase shifter 34 varies. The attenuation is proportional to the cosine of the angle of phase shift and the latter angle is proportional to the capacitance of the varactor, which, in turn, is varied by the bias. The setting of the voltages of varactors 36 and 38 of the variable phase shifter 34 establishes the net attenuation; bias control 48 includes an amplifier for driving these varactors the same amount so that the phase shift for each of the shifters 34 in attenuator stage 10 are the same. That is, the attenuation produced in the phase-controlled attenuator 10 is preferably divided equally and among two or three phase shifters 34 (only one of which is shown in FIG. 1 for simplicity of illustration).

The real components of the signal vectors in the parallel channels 32 aand 34 are additive and establish the attenuation. Since the fixed phase shifter 32 produces a constant attenuation, it serves to produce a reference attenuation against which that of the variable channel 34 varies. The imaginary vector components are in opposite directions, and generally they cancel only in part; consequently a net phase shift is produced in attenuator stage 10.

In the phase controlled attenuator, the power ratio from output to input is equal to one half plus one half of the cosine of the phase difference angle between the two channels. When there is not phase difference between the channels, the cosine is unity and the power ratio is unity; that is, zero attenuation. The combiner 40 is effective to establish this power ratio. One may start with the fixed reference bias, say at −10 volts and the variable bias can vary from say −10 volts (or −8 volts) for zero phase difference to −1 volt, which increases the capacitance and the phase difference. Alternatively, the reference bias may be at −1 volt and the varying channel bias changed from −1 volt to −10 volts for decreasing the capacitance and the phase difference. In either case, the same attenuation is achieved. The preferred reference bias position is that of −10 volts, that is to say to provide a larger reactance (a smaller capacitance). With this condition for the insertion loss state, the insertion losses are lower because the current losses in the residual resistance of the varactor (which is in series with its capacitance) is likewise smaller.

Only a single driver amplifier (the bias control 48) is required for generating the bias of the variable channel 34. The fixed bias of the reference channel 32 may be easily changed, for example, by a trimming resistor 39 to vary that voltage. Thereby, the attenuation curve can be adjusted and an optimum flatness can be readily achieved. The elimination of the driver for the fixed bias channel 32, which driver would be comparable in size to the attenuators, is important in achieving compactness.

Alternatively, both phase shifters 32 and 34 may receive varying biases and varying phase shifts and attenuating effects. For this purpose, the bias signals vary preferably equally in opposite directions for the two phase shifter stages 32 and 34. With either bias arrangement, the phase in one phase shifter (e.g., 32) is advanced (or retarded) with respect to the other. The combiner 40 adds the resultant signals, and the output is proportional to the cosine of the phase shift angle. The corresponding sine function values are equal and opposite for the two paths, so that they effectively cancel, and the output phase is not materially changed with respect to the input phase.

Figure 3:
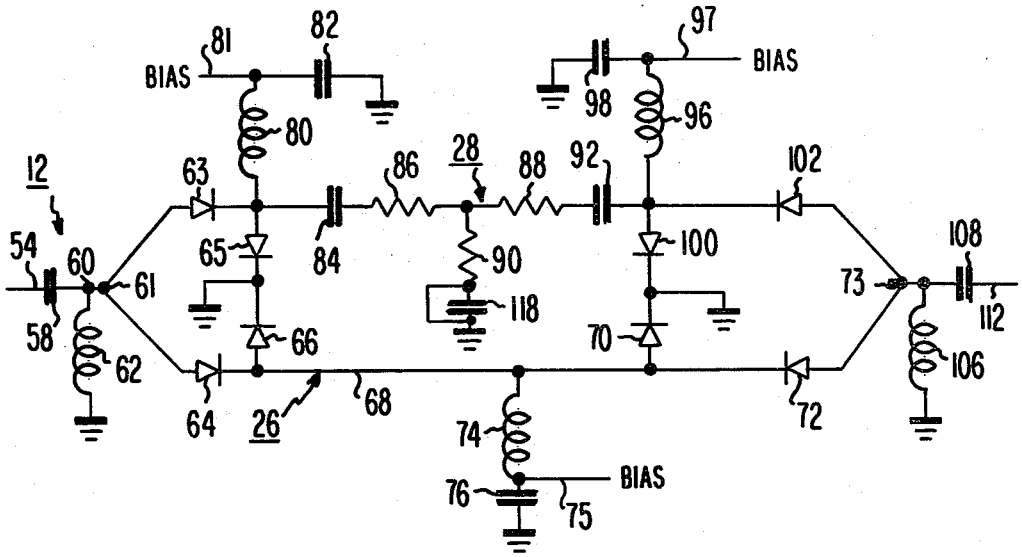
FIG. 3 is a schematic circuit diagram of the switched resistive-pad-attenuator stage of FIG. 2.
Figure 2:
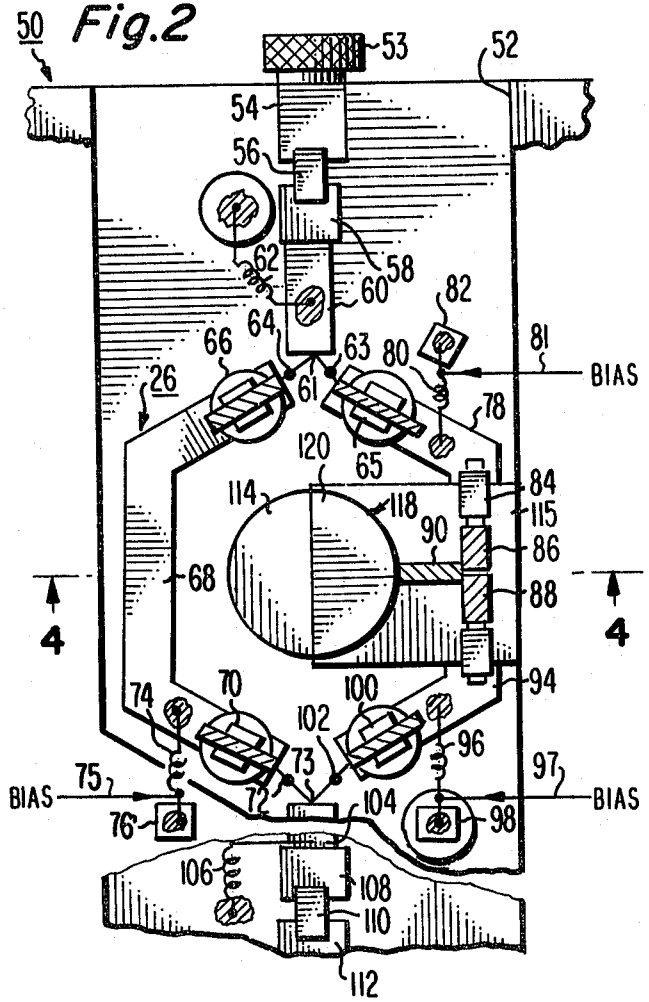
FIG. 2 is a plan view of a microstrip construction of one stage of the switched resistive-pad attenuator of FIG. 1.

Fabrication of the hybrid attenuator of FIG. 1 is preferably in a compact microstrip construction, and a preferred form of switch pad attenuator stage is shown in FIG. 2. The construction of a preferred analog phase shifter using a hybrid coupler is explained in the aformentioned patent; other constructions may be suitable. An integrated assembly of the two attenuators (phase-controlled and a phase-shiftless switch pad) employs a microstrip construction in which the port of one attenuator is connected directly to the port of the next for an extremely compact construction. The phase-shifter attenuator 10 may have a plurality of phase-shifter stages in each of the parallel paths between the splitter 30 and combiner 40. Shown in FIG. 2 is an enlarged plan view of the portion of such a microstrip assembly used for one stage 12 of the switch pad attenuator. In a metallic ground plane 50, a trough 52 is formed (shown in partial cross-section in FIG. 4) for the circuit elements of the attenuators. At one end, a coaxial connector 53 is attached, the center conductor 54 of which is reduced in a flat rectangular form as an extension thereof and as a port of the microstrip circuitry in the trough 52. This central conductor 54, which may be a rectangular tap of few hundreds of an inch in each dimension and a few thousandths of an inch thick, is connected by a metallic ribbon (e.g., gold) to a coupling capacitor 58, which in turn is connected to a microstrip section 60 mounted in the trough and spaced therefrom by a suitable dielectric. The microstrip 60 is connected through a choke 62 to d-c ground. At the other end of the microstrip 60, a junction 61 is formed from which respectively extend in diverging paths 26 and 28 two series PIN diodes 63, 64 of the beam lead type. A schematic circuit diagram of the construction of FIG. 2 is shown in FIG. 3, in which corresponding parts are referenced by similar numerals. The orientations of the diodes are illustrated in FIG. 3. In symmetrical relation, connected to the same one side of each series diode is a separate chip PIN diode 65, 66 and this chip diode is mounted (as shown in FIG. 3) is shunt relation to ground.

The insertion loss path 26 includes the series diode 64, shunt diode 66, the microstrip 68 connected to a similar shunt diode 70 and another series diode 72, and a chock 74 connected between the strip line and ground via capacitor 76. A d-c bias point 75 is formed at the junction of the choke and capacitor, and the latter insures r-f grounding of the choke.

The attenuation path 28 includes the series diode 63 and shunt diode 65, microstrip 78, which is connected to ground via choke coil 80 and capacitor 82. A d-c bias point 81 is formed at the junction thereof. The attenuation path 28 also includes a beam lead capacitor 84 connected between the microstrip 78 and a T-pad formed of two thin film resistive strips 86, 88 in series, and a strip 90 in shunt to ground. Another beam lead capacitor 92 is connected between the resistive film strip 88 and microstrip 94, which is connected to ground via choke 96 and capacitor 98, with a d-c bias point 97 being formed at the junction point of the latter two. Symmetrically, microstrip 94 has mounted thereon a chip PIN diode 100 which is connected in shunt to ground, and the microstrip is connected through a series diode 102 to the junction 73 to complete the attenuation path 28. The microstrip 104 at that junction is connected through a choke 106 to d-c- ground and through a capacitor 108, via ribbon 110, to a microstrip 112. The latter serves as the port of the stage 12 of the switch pad attenuator and is connected to the input port of power splitter 30 in the phase-controlled attenuator 10 shown in FIG. 1. Similarly, the output port of combiner 40 is connected to a similar microstrip port of switch pad stage 14, constructed in the same way.

Figure 4:
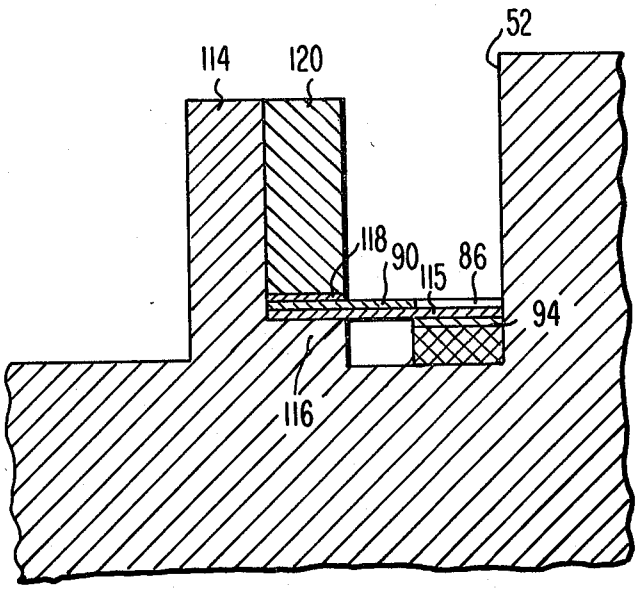
FIG. 4 is a cross-sectional elevation view of a portion of the switched-pad-attenuator stage of FIG. 2 as viewed along the line 4—4 thereof.

In the attenuation path, the T-pad resistors 86, 88 and 90 are preferably deposited as thin evaporated metallic films on a mica substrate 115 of rectangular form (e.g., which may be less than 0.1 inch on a side). The mica substrate 115 extends over half of a center post 114 which is shown as a cylindrical member that is press fit into (or milled from) the bottom of the ground-plane trough 52. The post 114 is illustrated in FIGS. 3 and 4 in cylindrical form with half of the post cut away to form a ledge 116 on which the substrate 115 (and a contact of the shunt resistor 90) rest. A semicircular metallic disc 118 is placed on top of the substrate and attaches the latter to the mating semicircular ledge 116 of the center post, and thereby forms a capacitive coupling to ground for the shunt-resistor lef 90 of the T-pad, as well as direct coupling to ground in the disc 118 and the post 114. The center post rises a substantial distance above the trough 52 and may be fabricated in various shapes, rectangular is preferred over round.

This metallic post 114 serves as an r-f shield to isolate the attenuation path 28 from the insertion loss path 26, which paths are otherwise in extremely close proximity and tend to be capacitively cross-coupled. For example, in an embodiment of the invention, the dimensions chosen are so small that the width of the trough 52 in which the microstrip circuitry is formed and mounted measures a couple of tenths of an inch, as does the spacing between the two junctions 61 and 73 in which the two paths 26 and 28 for attenuation and insertion loss, respectively, are located. The circuitry is constructed to keep the leakage signal to such a low value that the output signal power is not affected materially (e.g., by more than $\pm 0.1$ db). For that purpose, the power of the leakage should be very much attenuated from that of the output signal (e.g., 40 db down). Extremely high isolation is required between the two paths 26 and 28 notwithstanding their very close proximity. It has been found that the metallic post 114 is effective for this purpose. It shields the paths from any radiative cross-coupling notwithstanding large signal differences between the two paths 26 and 28.

With this construction, a symmetrical structure is achieved both in lateral and longitudinal directions. Moreover, the physical (and thus the electrical) lengths of the attenuation and insertion loss paths 28 and 26 are the same, so that the phases of the signals traversing from one junction 61 to the other 73 are the same. Thereby, the circuit operates as a phase-shiftless attenuator. The insertion loss path 26 tracks the attenuation path 28 with regard to circuit losses other than that of the attenuating T-pad, so that the two paths and the circuit overall is balanced. A single d-c bias point for the diodes in the insertion loss path 26 has been found sufficient, though a symmetrical connection may be provided if desired. In the attenuation path, the two d-c bias points at capacitors 82 and 98 and the coupling capacitors 84 and 92 isolate the d-c bias from the resistance T-pad.

The polarity of the bias voltages applied to bias points 81 and 97 is such (e.g., positive for the poling of the diodes shown in FIG. 3) as to render conductive shunt diodes 65 and 100 of the attenuation path and non-conductive series diodes 63 and 102, thereby to decouple the attenuation path 28. Concurrently, the bias voltage at point 75 is such (e.g., negative) as to render non-conductive shunt diodes 66 and 70 and conductive series diodes 64 and 72. Thereby, isolation path 26 conducts the modulating signal between ports 54 and 112. When the polarities of the bias voltages are reversed, the isolation path 26 is rendered non-conductive, and the attenuation path 28 conducts the modulating signal and attenuates it in accordance with the value of the T-pad 86, 88 and 90.

In the switch pad attenuator, the electrical length from switch to switch is made as short as possible to minimize VSWR effects. For example, the lengths of the electrical paths between the junctions 61 and 73 are about 0.2 inch. Likewise, the transverse distance between the insertion loss and the attenuation path is very small. The cross-sectional space in which they lie may also be less than 0.2 inch at the widest spacing. These dimensions are illustrative and chosen for a frequency range up to 18 GHz, the wave length of which is a little over half an inch. Thus, the symmetrical channels for the insertion loss and attenuation paths have lengths substantially less than half a wave length. These minimal path lengths minimize mismatch errors and additive reflections. Thereby the two paths have the same electrical lengths, and have a symmetrical arrangement of electrical elements except that the attenuation path contains the resistive pad.

The shunt resistor 90 of the T-pad is made as short as possible in length to minimize the inductance contributed by that length, and thereby minimize the frequency sensitivity over the broad microwave bandwidth with which it is used. The semicircular disc 118 serves to provide both a d-c and r-f ground for that shunt resistor 90. The d-c ground is through the disc directly to the post 114. The r-f ground is through the disc and the dielectric of the substrate 115 to the ledge 116. This capacitive coupling to ground occurs at the outer edge of the disc 118 so that the r-f coupling to ground minimizes the length of the shunt resistor 90.

Leakage modes tend to be propagated through the trough 52 operating as a hollow waveguide. These leakage modes bypass the attenuation paths as they propagate, so that some of the signal energy at the junction 61, which should pass through the attenuation path 28 or the insertion loss path 26 to junction 73, would tend to be propagated by the leakage mode without the attenuator controls and with consequent adverse effect on operation of the attenuator. To limit that leakage, the center post section 120, which is cut away to form the ledge 116, is restored and bonded to form the post 114, 120 of full transverse diameter. Thereby, the effective width of the propagating orifice on each side of the post is very much reduced (e.g., to about 30% of the diameter of the cross-sectional width of the trough itself). This narrowed propagating orifice attenuates the leakage to a negligible amount, so that it does not interfere with the controlled attenuation through the paths 28 and 26.

The center post 114 also serves as a heat sink through its ledge 116 and the mica substrate 115 on it in good thermal contact. A large amount of heat (e.g., about 100 milliwatts) in the T-pad is dissipated for maximum power handling capacity.

The phase-controlled attenuator 10 is effective by itself for small steps of attenuation over a small dynamic range of attenuation and for high speed operation in a broad frequency band to high microwave frequencies. However, to achieve a large dynamic range of attenuation, cascaded phase-controlled attenuators, each having a plurality of phase shifters in each channel, are needed and the insertion loss may be cumulatively high. The switch pad attenuator 12, 14, 16 is effective by itself for large steps of attenuation over a large dynamic range and a frequency band limited to lower frequencies (e.g., 0.5 to 8 GHz). However, through the individual switches have a fast transition time, the overall response time is substantially slower than that of the phase-controlled attenuation. In addition, the insertion loss is cumulatively high for the tendem-connected stages.

The integrated attenuator of FIG. 1, formed of the analog phase shifter attenuator 10 and switch pad attenuator 12, 14, 16, has the combined dynamic range of the two attenuators, both the small steps of the phased-controlled attenuator and the large steps of the switched pads. Generally, the integrated attenuator achieves for the high order bits the high speed of the phase-controlled attenuator in low order bits to within a small fraction of the attenuation of the switched pads for those high order bits. In addition, the combined attenuator can be designed with an insertion loss less than either of the two types of attenuators constructed to operate as a single type over the operating range of the combined attenuator. For example, the insertion loss of each of the phase-controlled attenuator 10 and the three switch pad attenuator stages 12, 14, 16 shown in FIG. 1 may illustratively be about 2.5 db so that overall the insertion loss is about 10 db. Were the switched pad attenuator 12, 14, 16 designed for the same dynamic range of attenuation, additional stages would be required for the lower order bits and the resulting insertion loss would be substantially greater. Similarly, a phase-controlled attenuator for the same dynamic range of attenuation made up of a plurality of stages such as stage 10 would also have a greater insertion loss.

While the flatness of a resistive pad by itself is superior to that obtained from a corresponding phase-controlled attenuating section, this advantage is lost when the pad becomes part of an assembly as in FIG. 1 due to circuit parasitics and mismatch effects. It has been found in practice that the flatness of a tandem array of three low attenuation switched pad assemblies is not better than that provided by a phase-controlled attenuator with the same dynamic range. The flatness of the latter can be substantially improved by operating over small phase shift angles (which are generally equal) in each of a plurality of cascaded sections in the single phase-controlled attenuator stage 10. Thereby, the effective phase shift angle is sufficiently large for the small attenuation steps but the operating characteristic in each section is limited to the flat central portion defined by its small phase shift angle.

With respect to accuracy, the integrated attenuator of FIG. 1 is superior. Over the ranges of 0 to 8.2 db, 8.8 db to 17.0 db, 17.6 to 25.8 db, 26.4 to 34.6 db, 35.2 to 43.3 db, 44.0 to 52.2 db, 52.8 to 61.0 db, and 61.6 to 69.8 db, there is complete monotonicity of successively programmed steps at any frequency, and correspondingly high resolution, a condition which is extremely difficult to achieve with an all pad design in the frequency ranges under discussion.

The use of the integrated attenuator avoids the switching of low resistance pads for low attenuation values where the response time of the switches is a significant factor (e.g., at very high microwave frequencies). That is, where the response time for switching the PIN diode switch is long so that the switch's attenuation value at the required switching time is significant compared to the attenuation of the resistance pad, such low value pads should not be used, and the controlled-phase attenuator can be used in its place. Where the response time of the switch is short so that its attenuation value at the required switching time is a small part of the attenuation pad value that it switches and is not significant, those values of pads can be employed. Generally, for the same fidelity, the varactors (and the phase-controlled attenuator) has for small attenuation values a shorter response time (or greater bandwidth) than the PIN diodes (and the switch pad attenuator).

In considering the switching speed limitation of the switch-pad attenuator, the diode switch must be distinguished from the idealized switch. The latter goes from open circuit to short circuit as a step function. However, in transition, the diode switch goes through the intermediate values of attenuation which can be substantial parts of the attenuation produced by the resistive pads that are switched in and out of operation.

Figure 5:
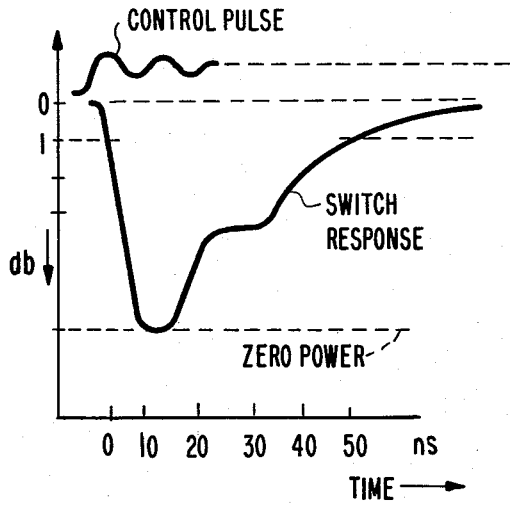
FIG. 5 is an idealized diagram of wave forms occurring in the switched-resistive-pad-attenuator stage of FIG. 3.

The two paths 26 and 28 of the switch pad attenuator contain identical switches operating in push-pull fashion. The switches are assumed to operate between two fixed, steady state conductance levels such that as the switches in one path go from one to the other state, the switches in the other path go synchronously in the reverse direction and vice versa. A rigorous solution of the transient response of the circuit of FIG. 2 operating at microwave frequencies and using PIN diodes as the switching elements is extremely involved. Nevertheless, it is possible to gain some insight into certain aspects of the problem without knowing the exact nature of the transient behavior. Thus, with the switches operating separately as a single pole single throw switch, a step function excitation, it is clear from the physics of the recombination process, causes the steady state conductance to be approached asymptotically, a condition which must also hold for the output power. Such asymptotic behavior is generally expressed by exponential terms. Now, while the true response turns out to be quite complex, being composed of many such terms with different time constants, we can establish an upper bound on the maximum speed of the process if we treat it as a single time constant response with a time constant corresponding to the rise time (e.g., of 3–4 ns) achievable with high speed PIN diode switches. In the case of such a switch reaching isolation at 65 db below the insertion loss level, this process would take 16.3 time constants to get within 1 db of this limiting level corresponding to a switching time of 25 ns if a time constant of 1.5 ns is assumed. In reality, however, this process will take considerably more time, particularly in its final approach to the isolation state. On the other hand, the return from the isolation state to within 1 db of the insertion loss state should be expected to take approximately the same time as going into isolation since the switch contains both series and shunt diodes. Thus, the reach the insertion loss state, the series diodes go into conduction while the shunt diodes go out of conduction, a process which is reversed when switching to the isolation state. Since PIN diodes can be very rapidly forced into conduction but not out of conduction, the true response of the switch, whether going into isolation or out of isolation, is thus characterized by a rapid change in its initial phase and a slow change in its final phase. Typically one finds a 10:1 change in the equivalent time constants of these phases of the response. We see, therefore, that switching between two channels, separated in the steady state condition by 65 db, with present diodes may take in excess of 25 ns to reach the final value within 1 db. The idealized waveform diagram in FIG. 5 showing the response of such a switching transient for particular diodes confirms these conclusions.

The effect of a resistive pad 28 in one of the paths may be considered under the requirement that the other path 26 should not affect the flatness of the pad attenuation by more than ±0.1 db over the band. Then for the largest bit of 24 db, the isolation level must be 40 db below that, or 64 db below the insertion loss level. Although one could relax somewhat on this requirement, it would not really improve matters since a series-shunt type of switch arrangement is desirable for other reasons, yielding thus the 65 db isolation level. It follows, therefore, that to switch under these conditions to within 1 db of any desired attenuation level, the time needed may be in excess of 25 ns.

The switching time response of the phase shifting portion of the attenuator is less; the varactor response itself can be considered to be instantaneous, so that the switching time is entirely limited by the driver circuitry. The latter is connected with the slewing rate of an operational amplifier requiring about 12 ns to generate about a 5 volt change corresponding to the 8.2 db attenuation level, and the delay through digital-to-analog converter and associated linearizing circuitry amounting to an additional 10 ns. Thus, it is seen that for the larger steps, the response of the phase-controlled section of the attenuator is about the same or even slightly better than that achievable with switched pads, and that for the smaller steps, the response is considerably better than that of switched pads. Even where the diode switching time has been improved to be close to that of the phase shifter, (the nanosecond times involved are noted above), the asymptotic change in the diode's attenuation (not a factor in the phase-controlled attenuator) is a time limiting factor.

The above-noted high isolation levels in the switch pad attenuator is a result of features of the FIG. 2 construction thereof. In the switch pad attenuator for wide band operation, the series diodes should be located as close as possible to the junctions, and particularly for very high frequencies, in order to achieve a high attenuation level in the insertion loss state. Similarly, the shunt diodes should also be as close as possible to the junctions. Such diodes should also be located at each junction. This configuration of series and shunt diodes gives excellent (e.g., about 40 db) isolation in the insertion loss state for the set of series and shunt diodes at either junction, and (e.g., 80 db) for the two sets of diodes at both junctions.

These phase controlled attenuator and the switch pad attenuator are highly dissimilar devices with different modes of operation and different circuit characteristics. Nevertheless, they are integrated in the attenuator of this invention, so that they cooperate most effectively to achieve operational characteristics that are not generally achievable separately by, either one. For example, as explained above, the high speed phase controlled attenuator used for the small attenuation steps provides operational characteristics not attainable with the switch pad attenuator alone, and particularly at the high frequencies of a broad microwave band. Likewise, the high resolution over almost the entire dynamic range is achievable with the phase controlled attenuator and its cooperation with the switch pad attenuator, though the least attenuation value that can be resolved in switching between the two types of attenuator is larger than the fine resolution contributed by the phase controlled attenuator itself. The large dynamic range is effectively achieved through the switch pad attenuation. The high speed of operation of the phase controlled attenuator is effectively coordinated with the slower speed of the switch pad operation by the selection of appropriate attenuation steps carried out by each attenuator type. The differences in mismatching, insertion loss and other circuit characteristics are effectively handled in their integration in the same overall unit. In addition, similar modes of microstrip construction are used for both (see U.S. Pat. No. 4,288,761 for the type of construction employed for the phase shifter) and the two attenuators are integrated in the same microstrip ground plane in a very compact form.

Thus, in accordance with this invention, a new and improved programmable attenuator is achieved in the integrated attenuator and in the separately usable phase-controlled and switched pad attenuators. The integrated attenuator is operable monotonically at high speeds over a large dynamic range of attenuation with small and large attenuation steps with high resolution and accuracy and with an insertion loss at an acceptable level. The phase-controlled attenuator is constructed to permit adjustment of the associated attenuation characteristic. The switch pad attenuator is constructed to be phase shiftless.

The forms of this invention described above and shown in the drawing are presented as preferred examples. It will be apparent to those skilled in the art that various changes in the construction and operational characteristics may be employed within this invention. For example, a plurality of phase-controlled attenuator stages similar to stage 10 may be employed as desired. Other attenuation ranges may be achieved and division of that range between phase-control and switch-pad may be variously achieved. Another example found satisfactory is that of 0 to 10.5 db in 1.5 db steps under phase-control along with a tandem pair of switched 12 and 24 db resistive pads for a 46.5 db dynamic range. The appended claims are intended to cover such modifications as are encompassed by the scope and spirit of this invention.

What is claimed is:

1. A digital programmable attenuator for microwave signals over a broad band of frequencies, said attenuator comprising:

a programmable phase shiftless resistive pad attenuator for switching large steps of attenuation including a plurality of pads of thin resistive films corresponding to said different large steps of attenuation, and means for switching at high speed different combinations of said resistive pads into and out of operation;

a programmable broadband phase-controlled attenuator for switching a plurality of small steps of attenuation, including means for controlling at high speeds the phase thereof to establish said small attenuation steps;

means for digitally programming the actuation of said attenuators into operation separately and together, including means for actuating said resistive pad attenuator to switch said combinations of thin film pads into and out of operation to establish said large attenuation steps, and for actuating the phase-controlling means of said phase-controlled attenuator to establish said small attenuation steps;

and means for connecting said attenuators in tandem to combine said large and small attenuation steps;

whereby a range of attenuation over a broad frequency band is provided with said small steps established monotonically between said large attenuation steps and with high resolution and accuracy.

2. A digital programmable attenuator as recited in claim 1 wherein said phase-controlled attenuator is an analog phase shifter.

3. A digital programmable attenuator as recited in claim 2 wherein said analog phase shifter is balanced and includes a plurality of phase shifter sections coupled in parallel channels.

4. A digital programmable attenuator as recited in claim 3 wherein said analog phase shifter sections are symmetrical along the signal path.

5. A digital programmable attenuator as recited in claim 3 wherein said phase controlling means includes means for varying the phase of the phase shifter section in one of said channels and for setting the phase of the phase shifter section in a parallel channel to a constant value.

6. A digital programmable attenuator as recited in claim 5 wherein one of said phase shifter sections includes a plurality of phase shifter stages, and said phase controlling means includes means for varying equally the phase of said plurality of phase shifter stages, said stages being cascaded to combine effectively the phase shifts thereof.

7. A digital programmable attenuator as recited in claim 1 wherein said resistive pad attenuator includes a plurality of stages each including an attenuation path having a different one of said resistive pads, an insertion loss path electrically similar to said attenuation path and without a resistive pad.

8. A digital programmable attenuator as recited in claim 7 wherein said attenuation and insertion loss paths are symmetrical therealong.

9. A digital programmable attenuator as recited in claim 7 wherein in each of said resistive-pad attenuator stages said switching means operates between said resistive-pad of the associated stage and the associated insertion loss path, and in said phase-controlled attenuator said means for controlling the phase thereof varies the attenuation among a plurality of predetermined values including an insertion loss value; whereby an advantageous insertion loss of the tandem attenuator is achieved.

10. A digital programmable attenuator as recited in claim 9, wherein the attenuation of the switching means of said resistive-pad attenuator is small compared to the attenuations of said resistive pads, whereby the switched attenuation steps are substantially unaffected by the switching means attenuation.

11. A digital programmable attenuator as recited in claim 7 wherein said phase-controlled attenuator is coupled between stages of said resistive pad attenuator.

12. A digital programmable attenuator as recited in claim 11 wherein said attenuators are constructed in microstrip and assembled on a common ground plane.

13. A digital programmable attenuator for microwave signals over a certain broad band of frequencies, said attenuator comrising:

a plurality of stages, each having two junctions and an attenuation path and an insertion loss path connected between said junctions, said paths having means for switching said attenuation path into and out of operation and said insertion loss path out of and into operation, respectively, between said junctions;

said attenuation and insertion loss paths being balanced and having the same electrical length between said junctions of each of said stages, said electrical length being substantially less than half a wavelength at the highest one of said microwave frequencies;

said attenuation and insertion loss paths being constructed in microstrip on a common ground plane in a trough formed in a metallic member, said paths being spaced a distance substantially less than half said wavelength;

a metallic shield being located between said paths for preventing cross-coupling between said paths.

each attenuation path including a pad of thin resistive films, the pads of said stages corresponding to different steps of attenuation over a range;

means for digitally programming the actuation of said switching means to switch different combinations of said attenuation paths and insertion loss paths into and out of operation;

and means for connecting said stages in tandem to combine the attenuation steps of the resistive pads in the ones of said attenuation paths switched into operation.

14. A digital programmable attenuator as recited in claim 13 wherein said shield includes a metallic member projecting up from the base of said trough and having a thickness along the transverse width of said trough equal to a substantial fraction thereof to reduce the effective width thereof for the transmission of leakage modes and thereby to reduce said leakage modes to a negligible level.

15. A digital programmable attenuator as recited in claim 13 wherein said switching means includes in each of said attenuator and insertion loss paths separate sets of series and shunt switching diodes, one of said diode sets being located at each end of each path and closely adjacent the two junctions of said paths.

16. A digital programmable attenuator as recited in claim 13 wherein said metallic shield includes a grounded metallic member projecting up from the base of said trough and between said paths, said pad of resistive films being mounted on a dielectric substrate, and a portion of said film pad being directly and capacitively grounded via said metallic member.

17. A digital programmable attenuator as recited in claim 16 wherein said substrate is thermally conductive and in contact with said metallic member for carrying away heat generated in said films during operation.

18. A digital programmable attenuator for microwave signals over a certain broad band of frequencies, said attenuator comprising:

a power splitter and a power combiner, a plurality of analog phase shifters connected in balanced relation in parallel channels between said power splitter and combiner, each of said phase shifters including variable reactive means for controlling the phase shift of the associated phase shifter;

means for adjustably setting the reactive phase shift controlling means in one of said channels to establish a fixed reference phase shift and adjust the attenuator's operating characteristic;

means for digitally programming variations of said phase shift controlling means in the other of said channels to produce corresponding variations in phase in the microwave signals in said other channel;

and means including said combiner for combining the microwave signals in both channels to establish different attenuation steps in said signals varying with said phase variations.

19. A digital programmable attenuator as recited in claim 18 wherein said phase shifter in one of said parallel channels includes a plurality of phase shifter stages, and said means for programming variations of said phase shift controlling means includes means for varying equally the phase of said plurality of phase shifter stages, said stages being cascaded to combine effectively the phase shifts thereof.

20. A digital programmable attenuator as recited in claim 19 wherein said reactive phase shift controlling means is fixedly set at a large reference reactance.

* * * * *